United States Patent [19]

Bressand et al.

[11] Patent Number: 4,519,624

[45] Date of Patent: May 28, 1985

[54] DEVICE FOR ADJUSTING THE LONGITUDINAL POSITION OF A SAFETY BINDING FOR SKI

[75] Inventors: René Bressand, St-Jorioz; Pierre Desarmaux, Pringy, both of France

[73] Assignee: Salomon S.A., Annecy, France

[21] Appl. No.: 328,521

[22] Filed: Dec. 8, 1981

[30] Foreign Application Priority Data

Oct. 12, 1980 [FR] France ..... 80 26213

[51] Int. Cl.[3] ..... A63C 9/00

[52] U.S. Cl. ..... 280/633

[58] Field of Search ..... 280/633, 636, 607; 24/60 A, 344, 345; 403/104, 107, 380

[56] References Cited

U.S. PATENT DOCUMENTS

| | | | |
|---|---|---|---|
| 2,822,613 | 2/1958 | Lundberg | 280/633 |
| 3,614,117 | 10/1971 | Iizuka et al. | 280/633 |
| 3,733,085 | 5/1973 | Iizuka | 280/633 |
| 3,785,666 | 1/1974 | Pierre et al. | 280/633 |
| 3,807,748 | 4/1974 | Ramillon | 280/633 |
| 3,839,758 | 10/1974 | Jack | 280/633 |
| 3,921,997 | 11/1975 | Begey | 280/633 |
| 4,157,193 | 6/1979 | Beyl | 280/633 |

FOREIGN PATENT DOCUMENTS

| | | | |
|---|---|---|---|
| 276180 | 2/1969 | Austria | 280/633 |
| 2406646 | 12/1974 | Fed. Rep. of Germany . | |
| 2541471 | 6/1976 | Fed. Rep. of Germany . | |
| 2617395 | 11/1977 | Fed. Rep. of Germany . | |
| 1498661 | 10/1967 | France . | |
| 2284347 | 9/1976 | France . | |
| 2340749 | 9/1977 | France . | |
| 469492 | 3/1969 | Switzerland | 280/633 |

*Primary Examiner*—David M. Mitchell

*Attorney, Agent, or Firm*—Sandler & Greenblum

[57] ABSTRACT

A device for adjusting the longitudinal position of a safety binding for a ski comprises a base plate mounted for longitudinal sliding movement in a guide fixed to the ski. A locking device is provided for locking the base plate, with respect to the guide, in one of a plurality of predetermined longitudinal positions. This locking device comprises a rotatable lock cooperating with a succession of lock notches spaced apart longitudinally from one another.

The locking device comprises, for each predetermined longitudinal position of the binding, two stops. The first stop defines a limiting position for the lock in its locked position in one of the notches. This first stop is formed by one end face of each lock notch. The second stop defines a limiting position for the lock when the lock is in an unlocked position in which the displacement of the base plate in the guide is permitted. The second stop is formed by the edge of a tooth disposed between two successive lock notches.

45 Claims, 17 Drawing Figures

DEVICE FOR ADJUSTING THE LONGITUDINAL POSITION OF A SAFETY BINDING FOR SKI

BACKGROUND OF THE INVENTION

The present invention relates to a device for a adjusting the longitudinal position of a safety binding for ski.

It is known in the art to hold a skier's boot on a ski between a front stop, immobilising the front end of the boot, and a rear heel member blocking the heel thereof. To enable these safety bindings to be used with boots of different sizes, it is known to provide for one of the front and rear holding means, generally the heel member, to be adjustable in longitudinal position so as to adapt the distance between the front stop and the rear heel member to the longitudinal dimensions of the boot which is held therebetween.

Various devices for adjusting the longitudinal position of safety binding are already known, including the device described in Swiss Pat. No. 469.492 filed on Dec. 4, 1967. The safety binding described in this Patent comprises a body of which the lower part may be displaced longitudinally in a guide. The body may be blocked in a predetermined longitudinal position by the engaging of a locking member, fast with the guide in one of a plurality of hollow sections made in the sliding lower part of the body of the binding, depending on the longitudinal position chosen. However, such a device has a certain number of drawbacks, including the total absence of the taking up of the clearance between the body and the guide and the indefinite position of the locking member which, in certain cases, prevents the displacement of the body of the binding. Furthermore, another very important drawback is that the body of the binding, which is longitudinally mobile, must be previously placed in a very precise longitudinal position for the locking member to be able to engage without difficulty in the corresponding hollow section.

SUMMARY OF THE INVENTION

It is an object of the invention essentially to remedy these drawbacks by providing an adjusting device of particularly simple design, allowing easy and sure passage from one position of adjustment to another and ensuring firm holding of the binding in its position of adjustment.

To the end, this device of the present invention is provided for adjusting the longitudinal position of a safety binding for a ski. The device comprises a base plate mounted for longitudinal sliding movement in a guide fixed to the ski and a locking device for locking the base plate with respect to the guide, in one of a plurality of determined longitudinal positions. The locking device further comprises a rotatable lock cooperating with a succession of lock notches spaced apart longitudinally from one another. For each predetermined longitudinal position of the binding, two stops, are provided. A first stop defines a locking position for the lock and prevents rotation of the lock beyond a limiting position and a second stop defines a limiting position for the lock as the lock is rotated from its locked position to its unlocked position and allows displacement of the base plate in the guide.

BRIEF DESCRIPTION OF THE DRAWINGS

The invention will be more readily understood from reading the following description with reference to the accompanying drawings, in which.

DESCRIPTION OF THE PREFERRED EMBODIMENT

Figure 1:
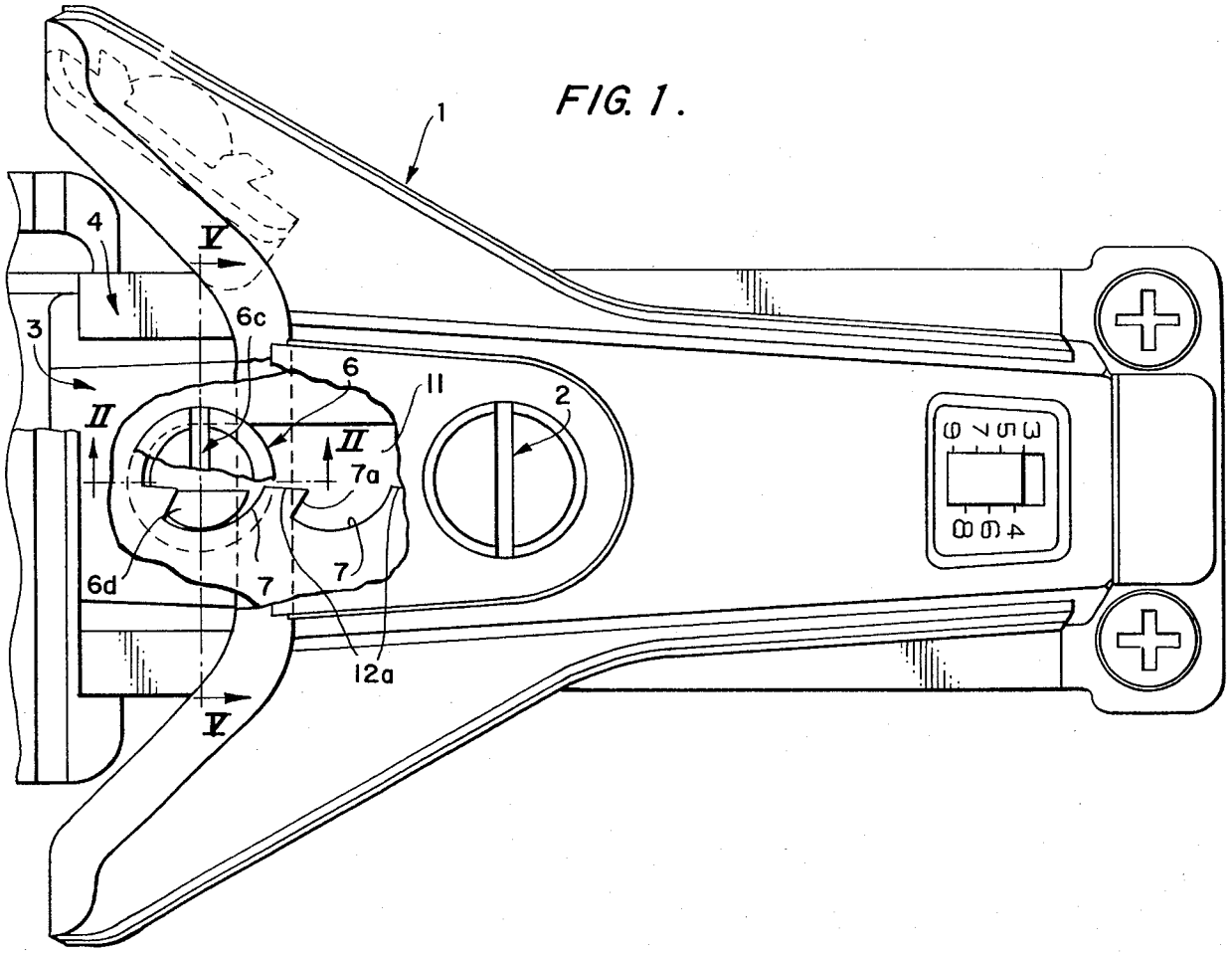
FIG. 1 is a plan view of a safety binding provided with the device of the present invention for adjusting the longitudinal position thereof.
Figure 2:
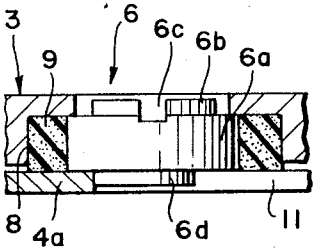
FIG. 2 is partial vertical and longitudinal section along line II—II of FIG. 1.
Figure 3:
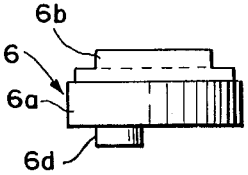
FIG. 3 is a view in elevation of the lock.
Figure 4:
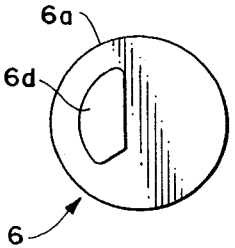
FIG. 4 is a view of the lock from underneath.
Figure 5:
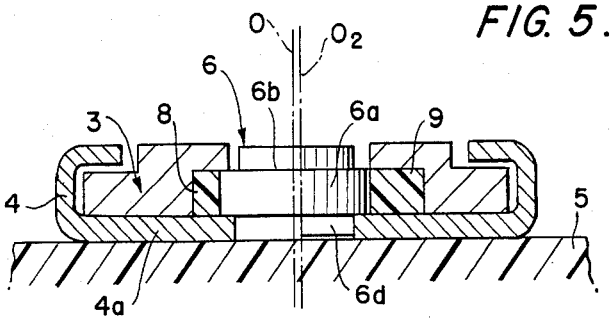
FIG. 5 is a vertical, transverse sectional view along line V—V of FIG. 1, the upper part of the binding being assumed to have been removed.

Referring now to the drawings, the device according to the invention which will now be described is applied to the adjustment of the longitudinal position of a safety binding comprising a front stop 1 as shown in FIG. 1. However, it is obvious that this device could also be applied to a rear heel member. The front stop 1 comprises a jaw which may pivot about a pin 2 perpendicular to the ski and which is borne by a base plate 3. This base plate is itself mounted for longitudinal sliding movement in a guide 4 fixed to ski 5 (FIG. 5).

Figure 16:
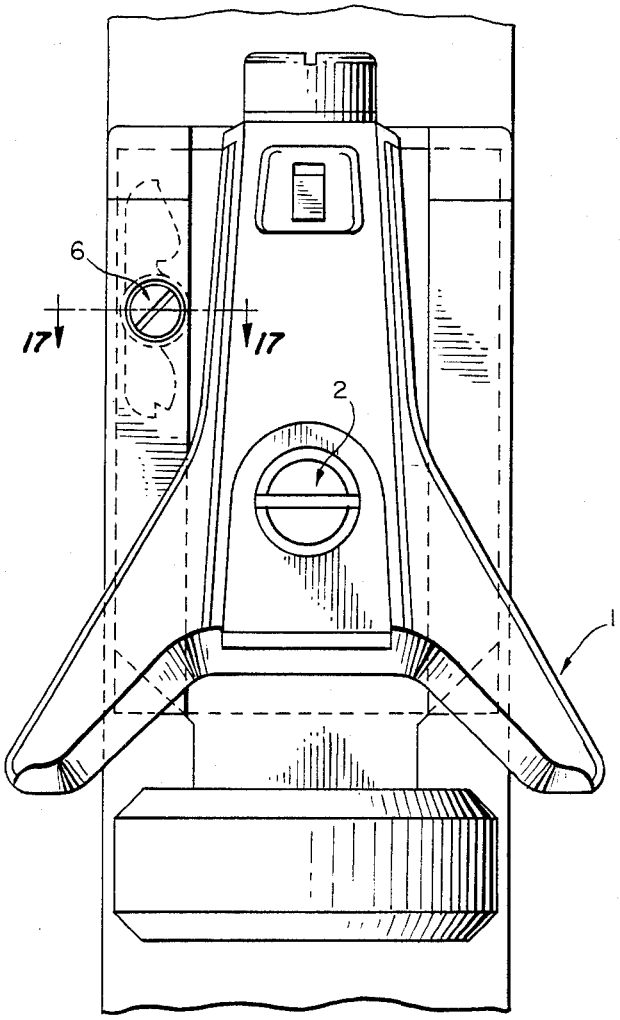
FIGS. 16 and 17 are top and cross sectional views, respectively, of an alternative embodiment of the device in which the lock is mounted on the guide and the notches are provided on the sliding base plate.
Figure 17:
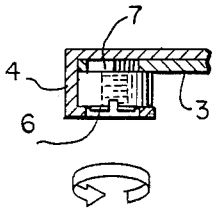

The device for adjusting the longitudinal position of front stop 1 comprises a locking device enabling base plate 3 to be locked with respect to guide 4 and consequently with respect to the ski, in one of a plurality of predetermined longitudinal positions spaced apart from one another. In the example which will be described, the device enables one of three separate longitudinal positions to be selected, but it is obvious that a different number of positions may be provided. The locking device comprises two elements cooperating together, one provided on a mobile base plate 3 and the other on guide 4, namely a rotatable lock 6 and a succession of lock notches 7. In the non-limiting embodiment which has been shown in the drawing, lock 6 is mounted to rotate on base plate 3 and lock notches 7 are provided on guide 4, but the opposite arrangement might also be adopted as seen in FIGS. 16 and 17.

Lock 6 comprises a cylindrical body 6*a* which is mounted to rotate in a cylindrical housing 8 provided in the lower face of base plate 3. An elastic washer 9 is interposed between cylindrical body 6*a* and the lateral wall of the housing 8. Lock 6 also comprises, above cylindrical body 6*a*, a maneuvering head 6*b* in which is made a diametrical slot 6*c* making it possible to insert a suitable tool, such as a screwdriver, into this slot to rotate lock 6.

Furthermore, lock 6 comprises, beneath cylindrical body 6*a*, on its lower face, a projecting locking lug 6*d* which cooperates with one of notches 7, as will be described in detail hereinafter.

In the central part or lower web 4*a* of the guide 4, which is applied on ski 5, a longitudinal slot 11 is made, of which one of the edges is rectilinear while the other edge comprises the succession of a lock notches 7, which are separated from each other by teeth 12.

Figure 6:
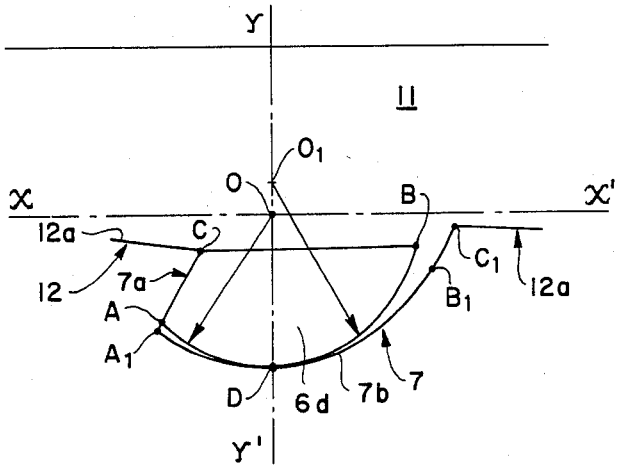
FIGS. 6, 7, 8, 9, 10, 11, 12, 13 and 14 are schematic diagrams illustrating the functioning of the locking device.
Figure 7:
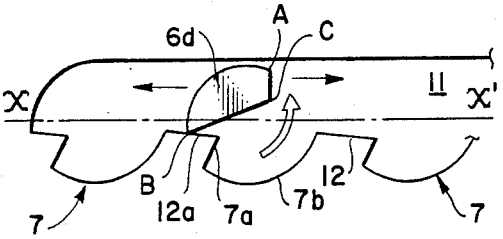

As may be more readily seen in FIG. 6, the vertical axis O, i.e. perpendicular to the ski, of lock 6 intersects the horizontal longitudinal axis xx' of guide 4. Locking lug 6*d* of lock 6 is defined by three faces, namely a circular locking face AB defined by an arc of circle of about 125° centred on axis O, a rectilinear face BC substantially parallel to the longitudinal axis xx' in locking position and another rectilinear face CA. In the locking position, this rectilinear face CA, which is inclined with respect to axis xx', is abuts a rectilinear face 7*a* defining towards the rear, i.e. in the direction of the boot, the lock notch 7. This lock notch 7 comprises, furthermore, another curved wall 7*b* which extends along an arc of circle between a point $A_1$ (contained in the plane face 7*a* forming the locking stop) and a point $B_1$, the arc $A_1B_1$ being about 100°. This arc $A_1B_1$ is extended by a rectilinear portion $B_1C_1$ forming a tangent to point $B_1$ and terminating the opening of the entire of the notch 7. The center $O_1$ arc of circle $A_1B_1$ is slightly offset with respect to the center O of the arc of circle AB, beyond the longitudinal axis xx', in the direction of the opposite edge of the slot 11, when lock 6 is in its locked position. The arc of circle AB thus has a curvature slightly greater than that of the arc of circle $A_1B_1$ and these two arcs are tangential, when lock 6 is in its locked position, at a point D located on the transverse axis yy' passing through the center O and $O_1$. To move from the locked position illustrated in FIG. 6 to the position illustrated in FIG. 7, it suffices to turn the lock 6 in counterclockwise direction, through an angle of at least 180°. At the end of this rotation, it is seen that point B of the locking lug 6*d* encounters an edge 12*a* of a tooth 12 which constitutes an unlocking stop. In other words, the rotation of the lock 6 from the locked position to the unlocked position is interrupted when point B comes into contact with unlocking stop 12*a*.

Figure 8:
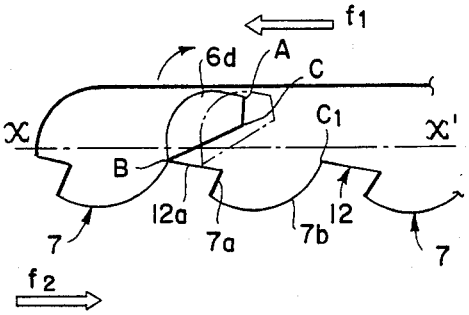
Figure 9:
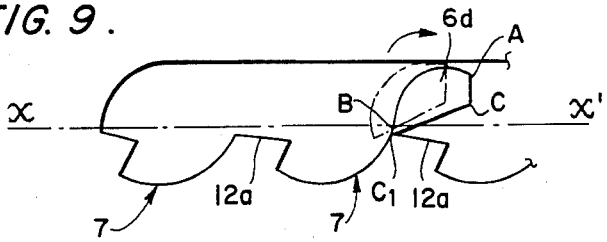

Once lock 6 is placed in the unlocked position, the entire binding 1 can slide forwards or backwards. As may be seen in FIGS. 6 and 7, edge 12*a* of tooth 12 comprising the unlocking stop is slightly inclined with respect to the longitudinal axis xx', so that edge 12*a* moves progressively away from this axis as edge 12*a* extends from the rear to the front. Consequently, inclined unlocking stop 12*a* performs the role of ramp, acting, during displacement, on the lock 6 to cause it to rotate and to place it in a retracted position in which locking lug 6*d* cannot hook on the lock notches during a rearward displacement in the direction in arrow $f_1$ of FIG. 8. It is seen that, in the course of this displacement, point B of the locking lug 6*d* slides on the ramp formed by unlocking stop 12*a* and is pushed by this ramp in the direction of the opposite edge of the longitudinal slot 11. Furthermore, in the unlocked position, rectilinear face BC of locking lug 6*d* is slightly inclined with respect to the longitudinal axis xx'. Consequently, a tip $C_1$ which is formed at the point at which curved wall 7*b* of notch 7 is connected to and edge 12*a* of the tooth 12 can no longer hook lock 6 during a forward displacement of the binding, as indicated by arrow $f_2$ in FIG. 9.

Figure 10:
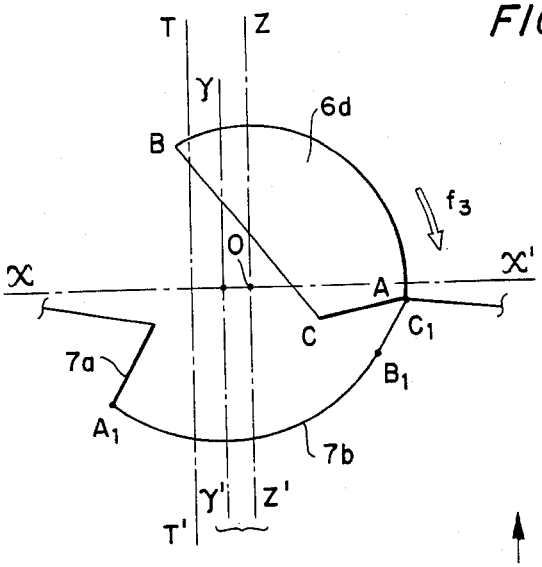

FIG. 10 shows that the portion of tangent $B_1C_1$ which extends the arc $A_1B_1$ makes it possible to obtain a wide opening of notch 7 and enables locking lug 6*d* always to find its place, even when the latter is not quite at the right spot. In fact, FIG. 10 shows that, if the axis O of the lock 6 is not found on the transverse axis yy' but is, on the contrary, slightly offset forwardly, for example on axis zz', locking lug 6*d* may, however, find its own way into the notch 7, since, during the rotation of the lock 6 in clockwise direction, to pass into locking position, point A of locking lug 6*d* encounters rectilinear ramp $C_1B_1$ which leads it up to the arc of circle $B_1A_1$. Consequently, the centering lug 6*d* is placed in the correct locking position and the axis O of the lock is located on the transverse axis yy' again. It is obvious that the axis O may also be offset rearwardly and be located for example on axis TT'.

Figure 11:
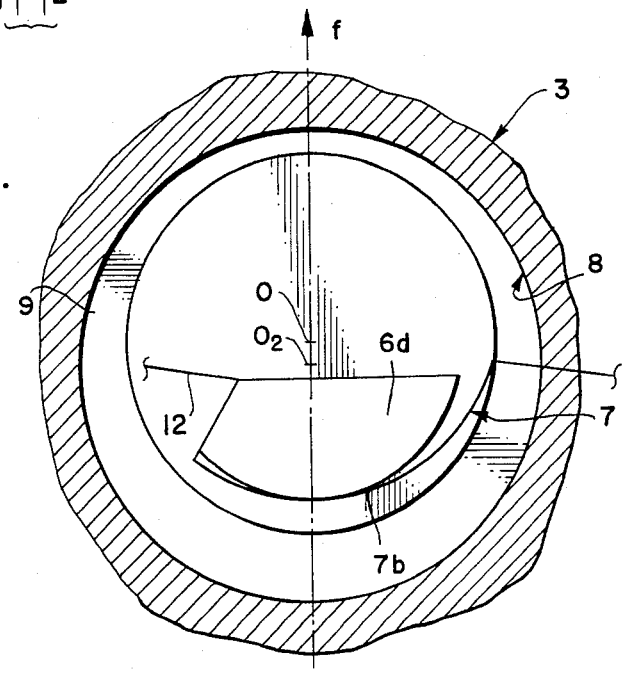

It has been seen hereinabove that lock 6 is retained laterally by an elastic washer 9 placed in housing 8. In the locked position, axis O of lock 6 is not merged with axis $O_2$ of the housing 8 and consequently of elastic washer 9 at rest. More particularly, as may be seen in FIG. 11, axis $O_2$ of housing 8 and of washer 9 is offset in the direction of the bottom of notch 7 with respect to axis O of lock 6. In other words, due to the offset between axes O and $O_2$, elastic washer 9 is compressed opposite notch 7 thereby causing locking lug 6*d* to be pressed against circular wall 7*b* notch 7, under the action of the elastic return force F due to the compression of washer 9. It is thus seen that the elastic cooperation between the clock 6 and the lock notch 7 forces the transverse sliding base plate 3 in guide 4, to make up the possible clearance between this guide and the body of the binding.

Figure 12:
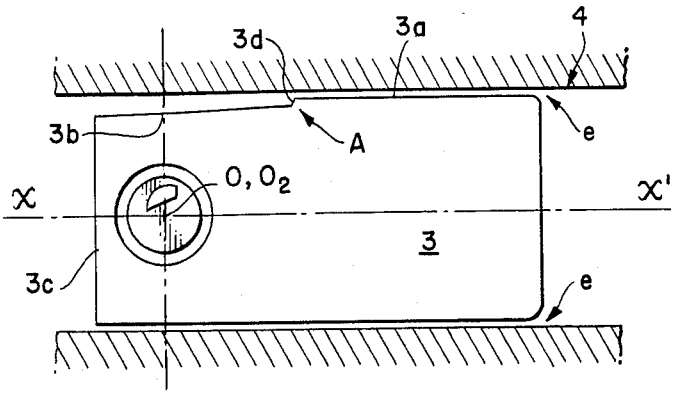
Figure 13:
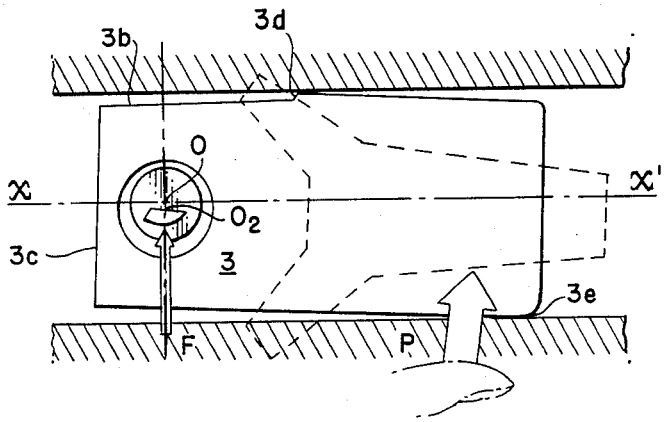
Figure 14:
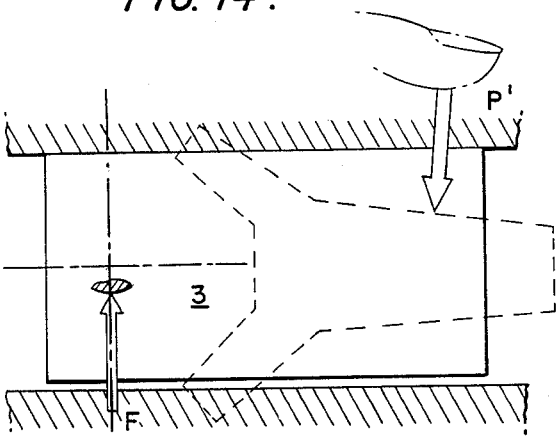

FIGS. 12 and 13 show that the sliding base plate comprises on part of its longitudinal edge 3*a* which is opposite the succession of notches 7, with respect to the longitudinal axis xx', a cut-out 3*b* which extends from the rear transverse edge 3*c* of base plate 3, up to a shoulder 3*d* by which cut-out 3*b* is connected to longitudinal edge 3*a*. The cut-out 3*b* extends over a sufficient length so that, whatever the longitudinal position in which the sliding base plate is locked, the transverse force F which is exerted on the base plate 3, due to the compression of the elastic washer 9, is applied at a point of the cut-out 3*b*. In the unlocked position (FIG. 12), base plate 3 may slide freely in the guide 4, due to clearances e being provided between its two longitudinal edges and the guide 4. In the locked position (FIG. 13), on the other hand these clearances must be made up: the force F exerted transversely on base plate 3 provokes a pivoting of this base plate in a clockwise direction about shoulder 3*d* acting as pivot axis and its apex 3*e* is applied against the edge of guide 4. In this position, the transverse clearance is made up and a relatively strong transverse force P must be exerted to displace base plate 3 transversely. If stabilisation cut-out 3*b* were not provided, as illustrated in FIG. 14, a very weak force P' would suffice to transversely displace sliding plate 3. The provision of the shoulder 3*d* acting as pivot axis enables transverse rigidity of the assembly to be increased under the effect of the return force F.

Figure 15:
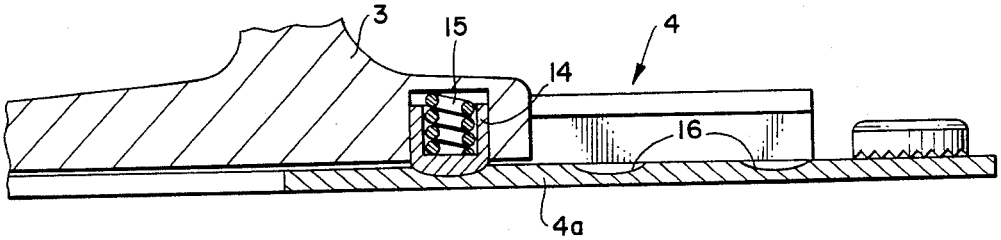
FIG. 15 is a partial vertical and longitudinal section illustrating an auxiliary device for determining the longitudinal positions.

FIG. 15 illustrates an auxiliary device for additionally determining the various longitudinal positions of sliding plate 3. This device comprises a small piston 14 placed in a housing in the sliding base plate 3 opening in the lower face thereof. This piston 14 is biased by a compression spring 15 and it is thus permanently pushed against the web 4*a* of the guide 4. This web comprises hollow parts 16 on its upper face which are aligned longitudinally along axis xx'. These hollow parts are adapted to receive the piston 14 in each of the longitudinal positions which the sliding plate 3 may occupy.

It is obvious that the embodiment of the invention which has been described hereinabove, with reference to the accompanying drawings, has been given purely by way of non-limiting example and that numerous modifications may be made thereto without departing from the scope of the invention. In particular, the lock 6 may be mounted to rotate about a horizontal pin disposed either longitudinally or transversely.

What is claimed is:

1. A device for adjusting the longitudinal position of a safety binding for a ski, comprising:

(a) a guide adapted to be fixed to said ski;

(b) a base plate adapted to be mounted for longitudinal movement in said guide; and (c) a locking means for locking said base plate, with respect to said guide, in one of a plurality of predetermined longitudinal positions, said locking means comprising:

(i) a rotatable lock rotatable into a locked position wherein said rotatable lock cooperates with any one of a succession of lock notches spaced apart longitudinally from one another each lock notch comprising an end portion, and wherein said rotatable lock is rotatable into an unlocked position allowing said base plate to be displaced longitudinally in said guide, and wherein said lock is unbiased for movement into said locked position, wherein said lock comprises a substantially cylindrical body mounted to rotate in a housing around a vertical axis, said body having a lower face, wherein said lower face comprises a locking lug adapted to engage said lock notches; and (ii) two stops for each predetermined longitudinal position of said binding, wherein said first stop comprises said end portion of said lock notch, wherein said first stop prevents rotation of said lock beyond a limiting position when said rotatable lock is in said locked position, and a second stop prevents rotation of said lock beyond a limiting position when said rotatable lock is in said unlocked position.

2. The device defined by claim 1, wherein said first stop is defined by a face forming the end part of said lock notch, and wherein said space between said lock notches comprises a tooth having an edge thereon and wherein said second stop is formed by the edge of said tooth between two successive lock notches.

3. The device defined by claim 2, wherein the edge comprising the second stop is inclined with respect to the longitudinal direction in which said base plate is adapted to be moved.

4. The device defined by claim 1, wherein said device further comprises an elastic washer and said housing comprises a substantially cylindrical wall and wherein said elastic washer is adapted to be interposed between said cylindrical body of said lock and said cylindrical wall of said housing.

5. The device defined by claim 1, wherein the lock comprises, above the cylindrical body, a maneuvering head comprising a diametrical slot adapted to receive a tool for rotating the lock.

6. The device defined by claim 1 wherein said rotatable lock is adapted to rotate about a first axis and wherein said lock notches have an end face comprising said first stop, and wherein said rotatable lock comprises a locking lug having a curved face and first and second rectilinear faces, wherein the point adjacent said curved face and said first rectilinear face is an apex, and wherein said curved face is in the shape of an arc of a circle whose center is on said first axis, and wherein said second face contacts said first stop when said lock is in said limiting position of said locked position and wherein said apex contacts said second stop when said lock is in said limiting position said unlocked position.

7. The device defined by claim 6 wherein said lock notches comprise a curved face being in the shape of an arc of a circle having a center and wherein said curved face of said rotatable lock has a curvature greater than that of said curved face of said lock notches, and wherein said curved face of said rotatable lock and said curved face of said lock notches are tangential to each other at a point on an axis transverse to the longitudinal axis of said ski and passing through said center of said curved face of said lock notch and said center of said curved face of said rotatable lock, wherein said two centers are spaced from each other.

8. The device defined by claim 4 wherein said notches comprise a rear portion, and wherein said washer comprises a zone located opposite from said notch and wherein said rotatable lock is adapted to rotate about a first axis, and wherein a second axis, substantially parallel to said first axis, passes through the center of said housing and washer, and, wherein, in said locked position said first axis is offset with respect to said second axis in the direction of said rear portion of the notch whereby said elastic washer is compressed in said zone located opposite the notch and an elastic return force is exerted transverse to the longitudinal axis of said ski.

9. The device defined by claim 8 wherein said base plate comprises a longitudinal edge on the opposite side of the longitudinal axis of said base plate from said lock notches, and wherein said longitudinal edge comprises:

(i) a cut-out portion; and (ii) a shoulder, wherein said shoulder connects said cut-out to said longitudinal edge, wherein said shoulder forms a pivot axis for said base plate, perpendicular to said ski.

10. The device defined by claim 1, wherein said guide comprises a web and wherein said rotatable lock is mounted to rotate on said base plate and said lock notches are provided on said web of said guide.

11. The device defined by claim 10, wherein said base plate further comprises a housing and wherein said rotatable lock is adapted to rotate, about a vertical axis in said housing and said web comprises a central, horizontal portion, intermediate the ends of said guide and extending horizontally across said ski, wherein said guide comprises, longitudinally extending slot in said central, horizontal portion of said web, having a longitudinal edge in which are located said succession of lock notches.

12. The device defined by claim 1, wherein said rotable lock is adapted to be mounted and to rotate on said guide and said succession of lock notches are located on said base plate.

13. The device defined by claim 1, wherein said rotatable lock is adapted to be mounted to rotate about a longitudinal or transverse horizontal pin.

14. The device defined by claim 1, wherein said device comprises a positioning element.

15. A device for adjusting the longitudinally position of a safety binding for a ski, comprising:

(a) a guide adapted to be fixed to said ski;

(b) a base plate having first and second longitudinal edges and adapted to be displaced longitudinally on said guide;

(c) locking means for locking said base plate in one of a plurality of predetermined longitudinal locked positions; and (d) rigidity means for increasing the transverse rigidity of said device when said locking means is in one of said locked positions, wherein said rigidity means comprises a pivoting means for pivoting said base plate against two opposite walls of said guide when said locking means is in one of said locked positions so that a first point on said first longitudinal edge of said base plate contacts said one wall of said guide, and a second point on said second edge of said base plate contacts the other wall of said guide, wherein said first and second points are spaced apart from each other in the longitudinal direction.

16. The device defined by claim 15 wherein said guide comprises first and second longitudinally extending walls wherein said first point contacts said first wall of said guide and said second point contacts said second wall of said guide.

17. The device defined by claim 16 wherein said pivoting means comprises:

(i) a housing in said base plate, for housing said locking means therein; and (ii) a washer disposed in said housing between said locking means and and said base plate, wherein said washer is adapted to produce said pivoting when said locking means is in its locked position.

18. The device defined by claim 17 wherein said locking means comprises a rotatable lock adapted to cooperate with a succession of lock notches longitudinally spaced apart, wherein said notches comprise a rear portion, and wherein said washer comprises a zone located opposite from said notches and wherein said rotatable lock is adapted to rotate about a first axis, and wherein a second axis, substantially parallel to said first axis, passes through the center of said housing and washer, and, wherein, in said locked position said first axis is offset with respect to said second axis in the direction of said rear portion of the notch, whereby said elastic washer is compressed in said zone located opposite the notch and an elastic return force is exerted transverse to the longitudinal axis of said ski.

19. The device defined by claim 18 wherein said housing comprises a substantially cylindrical wall within which said lock and housing are adapted to be housed, and wherein said lock comprises a substantially cylindrical body.

20. The device defined by claim 15 wherein said locking means comprises a rotatable lock, adapted to be rotated into a locked position wherein said lock cooperates with any one of said plurality of lock notches, and said rotatable lock is adapted to be rotated into an unlocked position allowing said base plate to be displaced longitudinally in said guide.

21. The device defined by claim 16 wherein said longitudinal edges of said base plate are spaced from said longitudinal walls of said guide when said locking means is in the unlocked position.

22. The device defined by claim 21 wherein device further comprises two stops, for each predetermined longitudinal position of said base plate, wherein said first stop is adapted to prevent rotation of said rotatable lock beyond a limiting position in said locked position, and said second stop is adapted to prevent rotation of said rotatable lock beyond a limiting position in said unlocked position.

23. The device defined by claim 22 wherein said locking means is unbiased for movement into said locked position.

24. The device defined by claim 15 wherein said locking means comprises a rotatable lock, adapted to be rotated into a locked position in any one of a plurality of lock notches spaced apart longitudinally from one another when said lock is aligned in the longitudinal direction with said notches, and wherein said notches comprise an alignment means for aligning said lock in the longitudinal direction when said lock is substantially misaligned in the longitudinal direction and when said lock is rotated into said locked position.

25. The device defined by claim 21 wherein said alignment means comprises a means for permitting said lock to enter said notches when said lock is misaligned in the longitudinal direction with respect to said notches.

26. The device defined by claim 25 wherein said lock has an arc-shaped portion with a center through which a first axis passes and said notches comprise an arc-shaped portion having a center, wherein said lock is aligned in said notches when said first axis passes through a transverse axis which passes through said center of said arc-shaped portion of said notches.

27. The device defined by claim 26 wherein said alignment means comprises a straight portion of said notches, tangent to said arc-shaped portion.

28. A device for adjusting the longitudinal position of a safety binding for a ski, comprising:

(a) a guide adapted to be fixed to a ski;

(b) a base plate adapted to be displaced longitudinally in said guide; and (c) locking means for locking said base plate in one of a plurality of predetermined longitudinal positions, wherein said locking means comprises a rotatable lock adapted to rotate from an unlocked position into a locked position, in which said lock engages any one of a plurality of lock notches spaced apart longitudinally from one another when said lock is aligned in the longitudinal direction with said notches, and wherein said notches comprise an alignment means for aligning said lock in the longitudinal direction when said lock is substantially misaligned in the longitudinal direction and when said lock is rotated into said locked position wherein said alignment means comprises means for permitting said lock to enter said notches when said lock is misaligned in the longitudinal direction with respect to said notches, and wherein said lock has an arc-shaped portion with a center through which a first axis passes and said notches comprise an arc-shaped portion having a center, wherein said lock is aligned in said notches when said first axis passes through a transverse axis which passes through said center of said arc-shaped portion of said notches.

29. The device defined by claim 28 wherein said alignment means comprises a straight portion of said notches, tangent to said arc-shaped portion.

30. A device for adjusting the longitudinal position of a ski binding comprising:

(a) a guide adapted to be fixed to a ski;

(b) a base plate adapted to be displaced longitudinally on said guide; and (c) locking means for locking said base plate in one of a plurality of predetermined longitudinal locked position said locking means comprising:

(i) a rotatable lock, adapted to be rotated around a vertical axis into a locked position wherein said rotatable lock cooperates with any one of a plurality of lock notches spaced apart in the longitudinal direction from one another, wherein each lock notch comprises an end portion, and wherein said rotatable lock is adapted to be rotated into an unlocked position allowing said base plate to be displaced longitudinally in said guide; and (ii) two stops for each predetermined longitudinal position of said base plate, wherein a first stop comprises said end portion of said notch and is adapted to prevent rotation of said lock beyond a limiting position when said rotatable lock is in said locked position, and wherein a second stop is adapted to prevent rotation of said lock beyond a limiting position when said lock is in the said unlocked position.

31. The device defined by claim 30 wherein said first stop is defined by a face forming the end part of said lock notch, and wherein said space between said lock notches comprises a tooth having an edge thereon and wherein second stop is formed by the edge of said tooth between two successive lock notches.

32. The device defined by claim 21 wherein the edge comprising the second stop is inclined with respect to the direction in which said base plate is adapted to be moved.

33. The device defined by claim 31 wherein each lock notch comprises:

(i) a rectilinear end face against which said lock is applied when in said locked position; and (ii) a curved face in the shape of an arc of a circle, said curved face having at one end a rectilinear portion forming a tangent to said arc of said circle and extending up to the end of the edge of said tooth.

34. The device defined by claim 30, wherein said lock comprises a lug on a lower face of said lock, adapted to engage said lock notches, wherein said rotatable lock is adapted to rotate about a first axis and wherein said lock notches have an end face comprising said first stop, and wherein said rotatable lock comprises a locking lug having a curved face and first and second rectilinear faces, wherein the point adjacent said curved face and said first rectilinear face is an apex, and wherein said curved face is in the shape of an arc of a circle whose center is on said first axis, and wherein said second face contacts said first stop when said lock is in said limiting position of said locked position and wherein said apex contacts said second stop when said lock is in said limiting position of said unlocked position.

35. A device for adjusting the longitudinal position of a safety binding for a ski, comprising:

(a) a guide adapted to be fixed to said ski;

(b) a base plate adapted to be mounted for longitudinal movement in said guide; and (c) a locking means for locking said base plate with respect to said guide in one of a plurality of predetermined longitudinal positions, said locking means comprising:

(i) a rotatable lock adapted to be rotated around a vertical axis through at least 45° from an unlocked position in which said binding is substantially free to be longitudinally displaced to a locked position wherein said rotatable lock cooperates with any one of a succession of lock notches spaced apart longitudinally from one another wherein each lock notch comprises an end face; and (ii) two stops for each predetermined longitudinal position of said binding, wherein a first stop comprises said end face of said notch and prevents rotation of said lock beyond a limiting position when said rotatable lock is in said locked position and a second stop prevents rotation of said lock beyond a limiting position when said rotatable lock is in said unlocked position.

36. The device defined by claim 35, wherein said first stop is defined by a face forming the end part of said lock notch, and wherein said space between said lock notches comprises a tooth having an edge thereon and wherein said second stop is formed by the edge of said tooth between two successive lock notches.

37. The device defined by claim 36, wherein the edge comprising the second stop is inclined with respect to the direction in which said base plate is adapted to be displaced.

38. The device defined by claim 36, wherein the lock notches comprise:

(i) a rectilinear end face against which said lock is applied when in said locking position; and (ii) a curved face in the shape of an arc of a circle, said curved face having at one end a rectilinear portion forming a tangent to said circle and extending up to the end of the edge of said tooth.

39. The device defined by claim 35, wherein said lock comprises a substantially cylindrical body mounted to rotate in a housing, said body having a lower face wherein said lower face comprises a locking lug adapted to engage said lock notches.

40. The device defined by claim 39, wherein said device further comprises an elastic washer and said housing comprises a substantially cylindrical wall and wherein said elastic washer is adapted to be interposed between said cylindrical body of said lock and said cylindrical wall of said housing.

41. The device defined by claim 39 wherein said rotatable lock is adapted to rotate about a first axis and wherein said lock notches have an end face comprising said first stop, and wherein said rotatable lock comprises a locking lug having a curved face and first and second rectilinear faces, wherein the point adjacent said curved face and said first rectilinear face is an apex, and wherein said curved face is in the shape of an arc of a circle whose center is on said first axis, and wherein said second face contacts said first stop when said lock is in said limiting position of said locked position and wherein said apex contacts said second stop when said lock is in said limiting position of said unlocked position.

42. The device defined by claim 41 wherein said lock notches comprise a curved face in the shape of an arc of a circle having a center and wherein said curved face of said rotatable lock has a curvature greater than that of said curved face of said lock notches and wherein said curved face of said rotatable lock and said curved face of said lock notches are tangential to each other at a point on an axis transverse to the longitudinal axis of said ski and passing through said center of said curved face of said lock notch and said center of said curved face of said rotatable lock, wherein said two centers are spaced from each other.

43. A device for adjusting the longitudinal position of a safety binding for a ski, comprising:

(a) a guide adapted to be fixed to said ski;
(b) a base plate adapted to be mounted for longitudinal movement in said guide; and
(c) a locking means for locking said base plate with respect to said guide, in one of a plurality of predetermined longitudinal positions, said locking means comprising:
(i) a rotatable lock rotatable into a locked position wherein said rotatable lock cooperates with any one of a succession of lock notches spaced apart longitudinally from one another and wherein said rotatable lock is rotatable into an unlocked position allowing said base plate to be displaced longitudinally in said guide, and wherein said lock is unbiased for movement into said locked position; and
(ii) first and second stops for each predetermined longitudinal position of said binding, wherein said first stop prevents rotation of said lock beyond a limiting position when said rotatable lock is in said locked position, and wherein said second stop prevents rotation of said lock beyond a limiting position when said rotatable lock is in said unlocked position, wherein said first stop is defined by a face forming the end part of said lock notch, and wherein said space between said lock notches comprises a tooth having an edge thereon, and wherein said second stop is formed by the edge of said tooth between two successive lock notches, and wherein each lock notch comprises:
a rectilinear end face against which said lock is applied when in said locked position; and
a curved face in the shape of an arc of a circle, said curved face having at one end a rectilinear portion forming a tangent to said arc of said circle and extending up to the end of the edge of said tooth.

44. A device for adjusting longitudinal position of a safety binding for a ski, comprising:
(a) a guide adapted to be fixed to said ski and comprising a hollow therein;
(b) a base plate adapted to be mounted for longitudinal movement in said guide; and
(c) a locking means for locking said base plate with respect to said guide, in one of a plurality of predetermined longitudinal positions, said locking means comprising:
(i) a rotatable lock rotatable into a locked position wherein said rotatable lock cooperates with any one of a successsion of lock notches spaced apart longitudinally from one another, and wherein said rotatable lock is rotatable into an unlocked position allowing said base plate to be displaced longitudinally in said guide, and wherein said lock is unbiased for movement into said locked position; and
(ii) first and second stops for each predetermined longitudinal position of said binding, wherein said first stop prevents rotation of said lock beyond a limiting position when said rotatable lock is in said locked position, and wherein said second stop prevents rotation of said lock beyond a limiting position when said rotatable lock is in said unlocked position,
wherein said device comprises a positioning element, and wherein said positioning element comprises a piston and a spring, both located in said hollow in said guide, wherein said spring is adapted to bias said piston.

45. A device for adjusting the longitudinal position of a safety binding for a ski, comprising:
(a) a guide adapted to be fixed to said ski;
(b) a base plate adapted to be mounted for longitudinal movement in said guide; and
(c) a locking means for locking said base plate, with respect to said guide, in one of a plurality of predetermined longitudinal positions, said locking means comprising:
(i) a rotatable lock rotatable into a locked position wherein said rotatable lock cooperates with any one of a succession of lock notches spaced apart longitudinally from one another wherein each lock notch comprises a rectilinear end face and wherein said rotatable lock is rotatable into an unlocked position allowing said base plate to be displaced longitudinally in said guide, and wherein said lock is unbiased for movement into said locked position, wherein said lock comprises a substantially cylindrical body mounted to rotate in a housing, said body having a lower face, wherein said lower face comprises a locking lug adapted to engage said lock notches; and
(ii) two stops for each predetermined longitudinal position of said binding, wherein said first stop comprises said rectilinear end face of said notch and prevents rotation of said lock beyond a limiting position when said rotatable lock is in said locked position, and a second stop prevents rotation of said lock beyond a limiting position when said rotatable lock is in said unlocked position.

* * * * *